United States Patent [19]

Gill

[11] 3,938,464

[45] Feb. 17, 1976

[54] CONTRA-ROTATING PROPELLER DRIVE SYSTEM

[76] Inventor: John D. Gill, Foot of Sixth St., Annapolis, Md. 21403

[22] Filed: Mar. 27, 1974

[21] Appl. No.: 455,229

[52] U.S. Cl. ..... 115/34 C

[51] Int. Cl.[2] ..... B63H 5/10

[58] Field of Search ..... 115/34 C, 34 R, 37

[56] References Cited

UNITED STATES PATENTS

| | | | |
|---|---|---|---|
| 768,336 | 8/1904 | Manker | 115/37 |
| 923,123 | 5/1906 | Ishoy | 115/37 |
| 1,843,574 | 2/1932 | May | 115/37 |
| 3,469,556 | 9/1969 | Campbell et al. | 115/34 C |
| 3,848,561 | 11/1974 | Price | 115/37 |

FOREIGN PATENTS OR APPLICATIONS

| | | | |
|---|---|---|---|
| 165,224 | 6/1921 | United Kingdom | 115/34 C |
| 68,161 | 7/1969 | Germany | 115/34 C |

*Primary Examiner*—Trygve M. Blix
*Assistant Examiner*—Stuart M. Goldstein
*Attorney, Agent, or Firm*—Rose & Edell

[57] ABSTRACT

A contra-rotating propeller system, particularly adapted for high speed water craft, is characterized by a movable support for at least one of two nominally-aligned and independently driven contra-rotating propellers. In a particular embodiment a forward propeller is driven by a forward engine via a forward drive shaft extending aftward and through the keel. The aft propeller is supported behind the forward propeller by a strut which serves as a rudder and as the housing for the aft propeller gear box. The forward and aft engines are preferably in longitudinal alignment to minimize hull width. The aft propeller strut is pivotable under control of the helm to effect steering.

13 Claims, 5 Drawing Figures

CONTRA-ROTATING PROPELLER DRIVE SYSTEM

BACKGROUND OF THE INVENTION

The present invention relates to propulsion systems for water craft and, more particularly, to an improved contra-rotating propeller arrangement.

It has long been recognized that contra-rotating propeller systems have the advantage of eliminating the turning effect or rolling effect of torque produced by the action of a single propeller. If a single propeller is employed, for example, the craft rudder must be used to compensate for the propeller-produced torque. The rudder thus introduces a drag factor which reduces the propulsion efficiency of the engine. This problem becomes more important in high speed water craft wherein the torque produced by a propeller is greater and hence the compensatory effect of the rudder must be greater. Moreover in rough water at high speeds the submersion level of the craft is variable so that the torque balancing effect of a rudder is irregular and can cause oscillatory rolling of the hull. Contra-rotating propellers permit balancing of the torque produced by each propeller, together with the effect of flow past the propeller support struts, and permit attainment of much higher propulsion efficiency factors.

Unfortunately, prior art contra-rotating propulsion systems, such as disclosed in U.S. Pat. No. 3,469,556 to Campbell et al, have suffered from practical problems which have restricted the utilization of these systems, particularly for high speed water craft. One such problem has been mechanical complexity of the propeller drive system, the complexity leading to unacceptable mechanical failure rates.

Another problem with prior art contra-rotating propellers relates to the fact that torque balance is achieved only over a small range of relative propeller speeds. Most contra-rotating propellers are driven by the same engine which limits the propeller speed ratios attainable and thereby limits the flexibility of the propulsion system. In the aforementioned Campbell et al patent it is suggested that the contra-rotating propellers be driven independently by separate engines. This permits torque balancing over a wide variety of conditions; however, the Campbell et al arrangement introduces other limiting factors. For example, Campbell et al mount the contra-rotating propellers on concentric drive shafts. The concentric shaft arrangement provides a larger wetted surface than a single shaft and therefore produces additional drag. Moreover, Campbell et al require that the engines be disposed along opposite sides of the concentric drive shafts, thereby requiring a wider hull than is optimum for high speed craft. Specifically, it is known that the ability of a hull to pass at high speeds over rough water with minimum impact force is closely related to the slenderness ratio of the hull. If machinery considerations dictate hull width, optimum hull design for high speed operation must suffer. Further, since Campbell et al drive the concentric propeller shafts via a common gear box, a single failure in either the gear box or the shaft structure can disable both propellers.

Still another problem associated with prior art contra-rotating propeller systems relates to the fixed physical orientation between the two propellers. That is, whether driven by concentric drive shafts or positioned side-by-side, no prior art contra-rotating propellers are movable relative to one another and to the craft hull. This limitation eliminates a dynamic steering capability wherein a propeller would be pivotable to produce a controllable and dynamic steering force on the craft. In addition, the fixed orientation permits no adjustment of the thrust axis direction which is a valuable capability in craft with planing-type hulls. Moreover, the fixed orientation prevents simple removal of one propeller for low speed operation so that the non-operating propeller does not remain in the water to present unwanted drag.

It is also desirable in most water craft, and particularly in high speed planing hulls to have the center of gravity of the craft as low as possible so that the craft is more stable in the water. In prior art contra-rotating propeller arrangements the locations of the engines and gear boxes, as dictated by the propeller location, is other than optimum.

It is therefore an object of the present invention to provide a contra-rotating propeller system which eliminates all of the aforementioned disadvantages.

It is another object of the present invention to provide a contra-rotating propeller arrangement which is suitable for use in high speed water craft and has a minimal wetted surface area.

It is another object of the present invention to provide a contra-rotating propeller system which has a built-in dynamic steering capability.

It is still another object of the present invention to provide a contra-rotating propeller system in which the supports for the propellers are movable relative to one another.

It is another object of the present invention to provide a contra-rotating propeller system wherein each propeller is independently driven by a separate engine but wherein the propellers are so oriented that the location of the engines does not dictate the width of the hull.

It is yet another object of the present invention to provide a contra-rotating propeller system with completely independent propeller drive systems.

It is another object of the present invention to locate the engines and gear box of a contra-rotating propeller system as low as possible to provide a low center of gravity for the craft.

SUMMARY OF THE INVENTION

In accordance with the present invention two contra-rotating propellers are independently supported, one behind the other, beneath the aft end of a water craft. The aft propeller support is in the form of a streamlined strut which houses the aft propeller gear box. The strut is pivotable about a nominally vertical axis in response to helm control so that the aft propeller is pivoted to effect dynamic steering while the strut serves as a rudder. The absence of a fixed orientation between the two propellers permits thrust direction adjustments to be achieved. In addition, the aft propeller support strut can be readily rotated up and out of the water, and a temporary rudder attached to the vessel, in the event that single-engine drive is desired. Alternatively, the aft propeller support strut can be used as a rudder with the aft engine idle.

The propellers are driven by independent engines which can be aligned longitudinally in the hull to minimize hull width. The forward propeller is driven by a forward engine via a drive shaft which extends through the hull and is supported in front of the aft engine gear box. The position of the propellers and aft gear box beneath the keel, along with the freedom to locate the engines as low as possible, permits a low center of gravity to be achieved.

BRIEF DESCRIPTION OF THE DRAWINGS

The above and still further objects, features and advantages of the present invention will become apparent upon consideration of the following detailed description of specific embodiments thereof, especially when taken in conjunction with the accompanying drawings, wherein.

DESCRIPTION OF PREFERRED EMBODIMENTS

Figure 1:
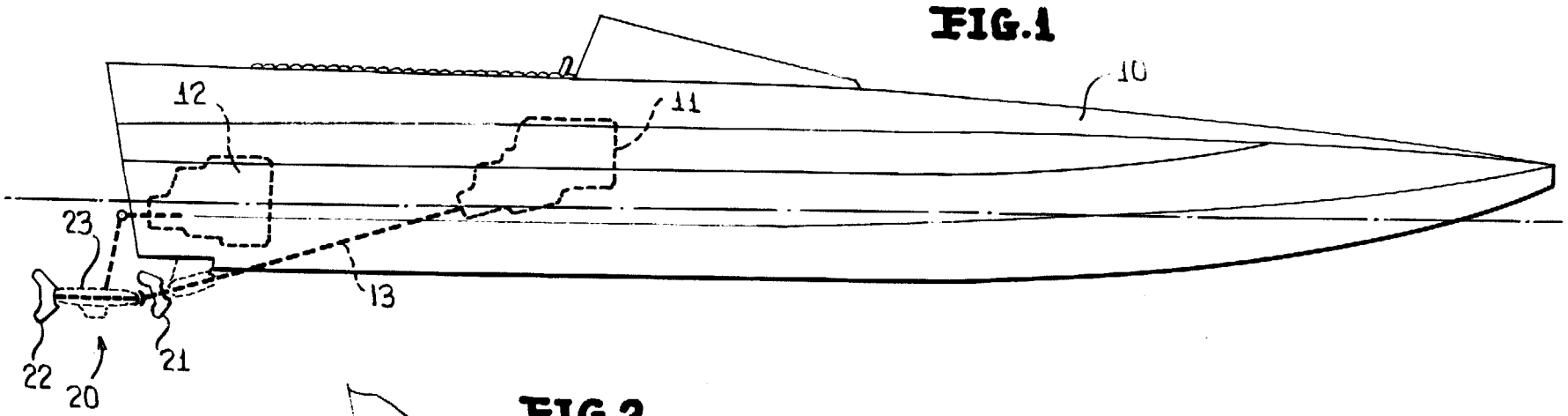
FIG. 1 is a schematic illustration of a vessel employing the contra-rotating propeller arrangement of the present invention.

Referring specifically to FIG. 1 of the accompanying drawings there is illustrated a vessel 10 employing a contra-rotational propeller arrangement 20. The propeller arrangement includes a forward propeller 21 and an aft propeller 22 nominally located in a common vertical plane substantially along the longitudinal center line of the vessel. Forward propeller 21 is rotatably driven by engine 11 via shaft 13 which extends downwardly and rearwardly from engine 11 through the keel of the vessel to the location of propeller 21 proximate the aft end of the vessel. Propeller 22 is independently driven by engine 12 through various couplings including a gear box located in a support strut 23 for propeller 22. Importantly, engines 11 and 12 are independent of one another and the linkages between the engines and their driven propellers are independent of one another. Therefore there is no reason to require that forward propeller 21 and aft propeller 22 be supported from the same structural member. In fact, in both embodiments disclosed herein, aft propeller 22 is free to pivot in a horizontal plane, under control of the vessel steering mechanism, without moving forward propeller 21. The vessel can thus be dynamically steered and still maintain the advantages of contra-rotating propeller operation.

Engines 11 and 12 are located in a common vertical plane extending longitudinally of craft 10. This plane is preferably the same plane containing the propellers 21 and 22 so that the entire drive system for both propellers is located along the longitudinal center line of the craft. When so positioned the propulsion system has minimum effect on the width requirement for the hull. Likewise, the engines 11 and 12 can be located as close to the keel of the vessel as required so that the center of gravity of the vessel can be made as low as possible.

Figure 2:
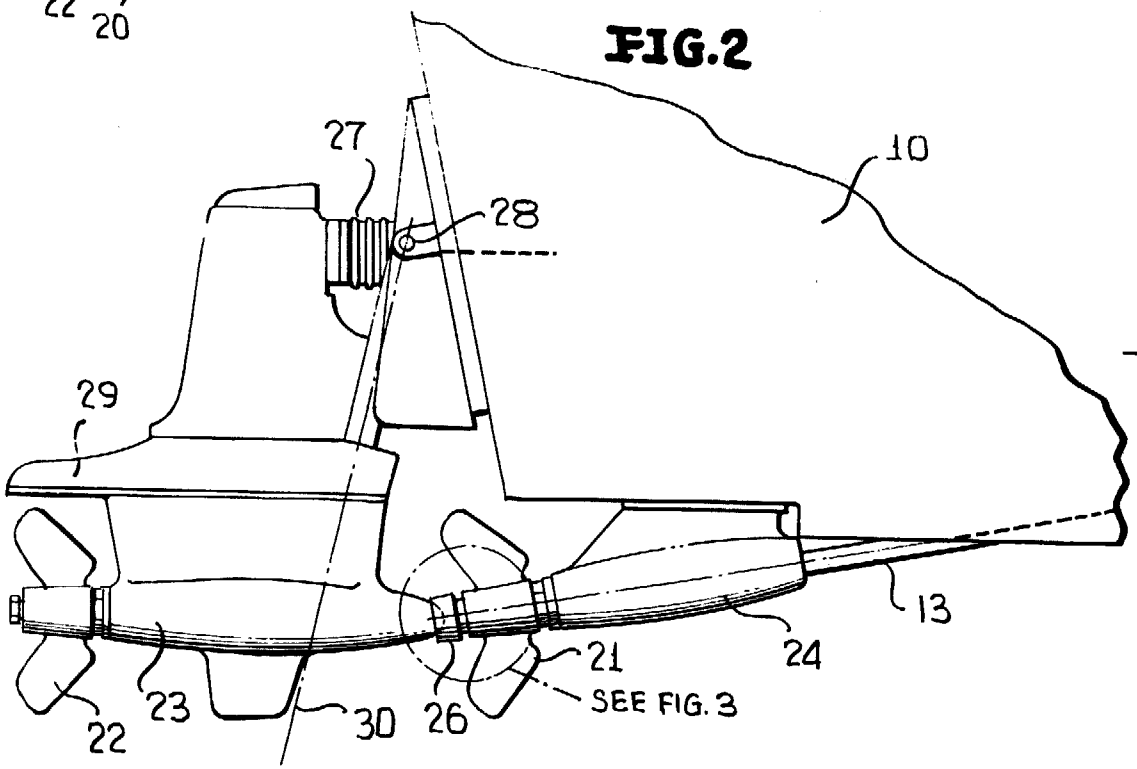
FIG. 2 is a partial plan view of one embodiment of the contra-rotating propeller arrangement of the present invention.
Figure 3:
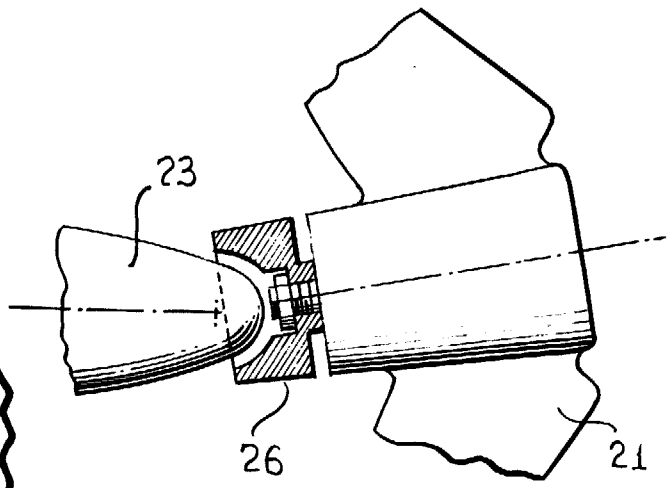
FIG. 3 is a detailed plan view of a portion of the embodiment illustrated in FIG. 2.

Referring specifically to FIGS. 2 and 3 of the accompanying drawings for one specific embodiment of the present invention, aft propeller 22 is supported at the aft end of strut 23 which houses the aft propeller drive gear box. Strut 23 is in turn supported from the aft end of vessel 10 and projects to a depth below the keel of the vessel. Forward propeller 21, located proximate the rearward end of shaft 13, is disposed immediately adjacent but not in contact with the forward end of strut 23. Shaft 13 is supported for this purpose by means of strut 24 extending downward from the keel of the vessel.

A cylindrical fairing 26 is secured to the aft end of shaft 13 and includes an aft surface which is contoured to surround but not contact the nose of strut 23. Fairing 26 thus serves to provide a smooth transition for flow from forward propeller 21 to the streamlined strut 23. The entire aft strut assembly 23 is pivotable about a substantially vertical steering axis 30 by means of substantially any commonly available sterndrive tiller operated under the control of the vessel helm. As strut member 23 is rotated about axis 30, the nose of the strut remains within the confines of the recess in fairing 26 for small steering operations typical of high speed or cruising speed requirements. Therefore smooth flow conditions are maintained between the forward propeller and the aft propeller support structure under these conditions. When strut 23 is rotated, it rotates aft propeller 22 to thereby provide a dynamic steering effect for the vessel. In addition, strut 23 acts as a rudder with respect to flow past forward propeller 21.

The support for strut 23 includes a protective neoprene boot 27 extending horizontally and rearwardly from the aft end of the vessel and housing mechanical components. Strut 23 is secured to the aft end of this assembly and projects downwardly therefrom below the water line. The mechanical components, as is common for such stern drive units, include a double universal joint or similar mechanism which enables strut 23 to be rotated about a transversely-extending axis 28. In this manner the strut 23 and aft propeller 22 can be pivoted rearwardly and up out of the water and stowed so that they do not introduce drag when it is desired to drive the vessel solely with forward propeller 21. Under such conditions a temporary rudder may be attached to the vessel stern. Alternatively, single-engine operation may be effected by simply keeping aft propeller 22 idle and employing strut 23 as a rudder.

Figure 4:
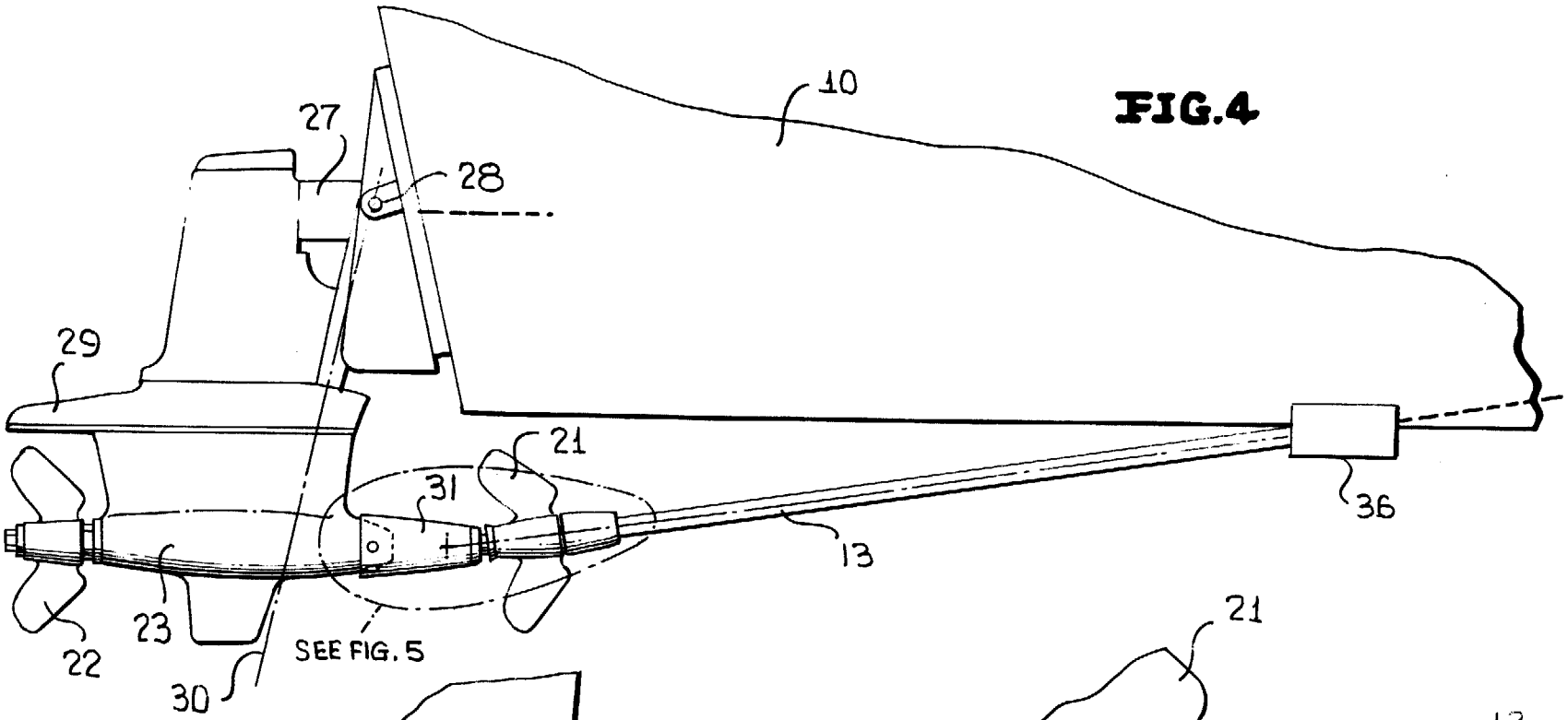
FIG. 4 is a partial plan view of a second embodiment of the contra-rotating propeller arrangement of the present invention.
Figure 5:
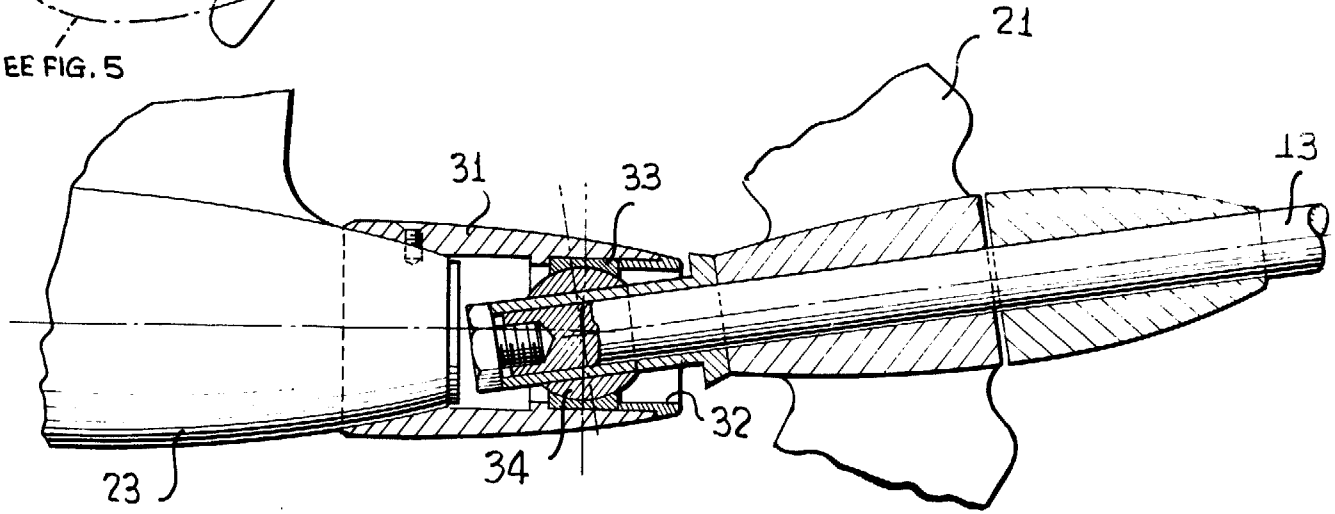
FIG. 5 is a detailed plan view of a portion of the embodiment illustrated in FIG. 4.

Referring to FIGS. 4 and 5 of the accompanying drawings, a second embodiment of the present invention is illustrated in detail. Specifically, the embodiment of FIGS. 4 and 5 is a modified version of the embodiment of FIGS. 2 and 3, both embodiments including forward propeller 21, aft propeller 22, forward propeller drive shaft 13, rear propeller gear box 23, and steering axis 30. In FIGS. 4 and 5 the nose of the strut 23 carries a ball joint assembly 31 which supports forward propeller 21. Specifically, ball joint assembly 31 includes a streamlined housing secured to the forward end of strut 23 and is provided with an internal longitudinally-extending bore 32 carrying a socket 33. The socket is arranged to receive a ball member 34 for universal movement within the socket. Ball 34 includes a central bore through which the drive shaft 13 extends. Shaft 13 rotates freely within the bore of ball 34 and is water-lubricated by means of the ambient water within which the craft is located. When strut 23 and aft propeller 22 are pivoted about the nominally vertical steering axis 30, socket 33 pivots about ball member 34. Consequently, for purposes of steering, the aft propeller 22 is free to pivot without corresponding movement of forward propeller 21. The relative advantages and disadvantages of the embodiment of FIGS. 4 and 5 relative to the embodiment of FIGS. 2 and 3 shall be discussed below after a brief discussion of the general operation of both embodiments.

As described in the aforementioned Campbell et al patent, the use of contra-rotating propellers, independently driven, permits optimization of torque balance in the propulsion elements of the vessel whereby greater stability is achieved. Specifically, the ratio of the speeds of the two propellers for optimum torque balance varies with windage, wetted length of the vessel structure, sea conditions, etc. Unless the propellers can be independently controlled, the ratio of their rotational speeds cannot be optimized for these various conditions. Moreover, during heavy wind conditions a vessel tends to lean into the wind; the torque ratio, when separate engines are utilized, can be adjusted to overcome this problem. By effectively mechanically de-coupling the two propellers, as achieved with the present invention, the aforementioned advantages of using separate engines for the propellers are extended to permit dynamic steering of the vessel with greater vessel stability.

A primary advantage in the embodiment of FIG. 4 over the embodiment of FIG. 2 resides in the deletion of support strut 24 for forward propeller driving shaft 13. When such a strut is used, it has greater wetted area and profile area than a simple nose cone configuration such as that of the assembly 31. The reduction in wetted area increases the hydrodynamic efficiency of the propulsion system. In fact, the nose cone configuration of assembly 31 rides in the wake of the forward propeller and acts as a fairing to guide flow smoothly from the forward propeller hub to the strut 23. Strut 24, on the other hand, creates some turbulance in its wake and thereby has an adverse effect on the efficiency of the forward propeller. The resulting increase in hydrodynamic efficiency provided by the embodiment illustrated in FIGS. 4 and 5 is achieved at the expense of additional mechanical complexity relative to the structure of FIGS. 2 and 3. It will be noted, for example, that the steering axis (i.e. the axis of steering shaft 30) does not coincide with the pivot point in ball joint assembly 31. Therefore, during a steering operation the forward propeller 21 and its drive shaft 13 are moved a short distance transversely of the craft axis. This requires either a slight bending of the forward propeller drive shaft about a rigid bearing in the hull or the utilization of a flexible coupling in shaft 13 at the point where the shaft enters the hull. Such a flexible coupling, which may be a commercially available non-alignment type coupling, is schematically illustrated at 36 in FIG. 4.

It should be pointed out that the axes about which each of the propellers rotate need not be parallel to the water line of the craft. In fact, in the embodiments illustrated herein the forward propeller rotates about an axis which is approximately 10° displaced from the water line. The particular angle is strictly one of choice and is determined by the nature of the vessel with which the propellers are to be used. For example, vessels with planing hulls benefit from the ability to change the thrust axis to permit the hull to plane at a more efficient angle. The absence of rigid mechanical coupling between the propellers permits proper selection of thrust angle for each propeller to thereby optimize thrust and minimize hydrodynamic drag for a particular vessel application. For example, if strut 23 is only partially pivoted about axis 28, the axis of rotation of the aft propeller 22 may be adjusted accordingly. This partial pivoting of the strut may be controlled during vessel operation to provide power trim as needed. In the case of the embodiment of FIG. 4, coupling 36 would provide sufficient "play" for shaft 13 to permit this type of movement of strut 23; however, it will be noted that a much greater freedom is provided in the embodiment of FIG. 2 wherein no axial constraint exists between the two propeller supports. It should also be noted that a splined shaft may be utilized in conjunction with shaft 13 in the FIG. 4 embodiment if greater freedom of movement is desired. The important point is that the axes of rotation of the propellers may be controllably angularly misaligned to effect the desired power trim.

The propeller axes may also be mutually adjusted vertically for certain specific purposes. For example, the member designated 29 in FIGS. 2 and 4 is conventionally known as a cavitation plate. Its function for low speed operation is to keep air out of the aft propeller area. At high speeds, however, it is desirable that plate 29 and part of the strut ride above the surface to reduce drag. This is efficiently effected by positioning forward propeller 21 vertically or orienting its shaft angle so that its wake controllably depresses the water surface proximate the aft propeller and thereby provides the designer with a measure of control over the submersion of strut 23. Such controlled positioning of the forward propeller is within the scope of the present invention.

My invention as thus described contemplates the mechanical decoupling of two independently driven contra-rotating propellers so that each may be pivoted independently of the other for purposes of steering and thrust-vectoring the vessel. This flexibility is achieved without sacrificing the attendant advantages of a contra-rotating propeller drive assembly, and in fact retains those advantages as well as the advantage of optimization of torque balance resulting from independent propeller drive sources. Moreover the use of completely independent power transmission paths to the two propellers permits the entire propulsion system (i.e. engines, drive shafts, gear box, propellers) to be located along the vessel centerline so that a minimum hull width can be obtained. Likewise the propulsion system components can be located as low as desired in the vessel to enhance vessel stability.

Strut assembly 23 may preferably be any of a number of standard and commercially available stern drive assemblies. As illustrated, aft propeller 22 is secured to the aft end of such assembly. It is possible, and such units are also commercially available, to have aft propeller 22 secured to the forward end of strut assembly 23. Under such circumstances the aft propeller 22 is positioned directly behind forward propeller 21, a configuration which is advantageous for certain applications. Specifically, for this configuration the aft propeller is able to more completely compensate for rotational flow introduced by the forward propeller so that a more nearly pure overall axial flow can be achieved. Such axial flow is attainable over only a narrow range of velocities; however, over that velocity range the propulsion system is considerably more efficient than the peak efficiency obtainable with the aft propeller located at the aft end of strut 23.

It is mentioned herein that longitudinal alignment of the engines is advantageous for high speed craft because of the desirability of a narrow hull in such craft. It should also be mentioned that the engine positioning permitted by the present inventive concept is advantageous for slower craft. Specifically, if the engines are longitudinally aligned and placed lower in the hull, as permitted by my invention, a deeper deck and larger deck space is available. This is particularly advantageous for fishing boats and is also desirable for pleasure craft. Importantly, this added space can be made available without reducing engine size.

It should be noted that other known expedients can be employed to enhance the concepts of the present invention for particular applications. For example, it may be desirable to position the forward engine 11 further aft in the hull. This can be achieved by employing a conventional marine V-drive to redirect the energy transmission path. Or it may be desirable, in the embodiment of FIG. 2, to locate strut 24 aft of forward propeller 21 but still not contacting aft strut 23. For any and all embodiments, it is apparent that standard commonly available components may be employed, thereby providing a considerable cost-saving over most contra-rotating propeller systems.

It should be further noted that certain standard components described and illustrated herein represent only specific embodiments for which substitution can be made. Specifically, the stern drive unit described herein need not take the configuration illustrated, but rather could be any commercially available or specially designed stern drive capable of pivoting about an axis such as axis 30 for steering and about an axis such as axis 28 for power trim.

While I have described and illustrated specific embodiments of my invention, it will be clear that variations of the details of construction which are specifically illustrated and described may be resorted to without departing from the true spirit and scope of the invention as defined in the appended claims.

I claim:

1. A contra-rotating propulsion system for a water craft having a hull defined along its bottom by a keel, said system comprising:

a forward propeller having blades disposed about a first axis of rotation;

an aft propeller having blades disposed about a second axis of rotation;

said first and second axes of rotation being vertically co-planar;

means for supporting said forward and aft propellers one behind the other below the depth of said keel in a manner to permit independent movement of at least one of said propellers relative to the other;

a first engine located in said hull;

first drive means coupling said first engine to said forward propeller for imparting forward motion to said craft by rotating the blades of said first propeller about said first axis of rotation;

a second engine located in said hull; and second drive means entirely independent of said first drive means coupling said second engine to said aft propeller for imparting forward motion to said craft by rotating the blades of said second propeller about said second axis of rotation in contra-rotation to said forward propeller.

2. The system according to claim 1 wherein said first engine is located in said hull forward of said forward propeller and wherein said first drive means includes a first drive shaft rotatably engaged by said first engine and extending generally rearwardly from said first engine through said keel to a location forward of said aft propeller, said first drive shaft being disposed concentrically about said first axis of rotation, said forward propeller being secured to said first drive shaft for rotation therewith.

3. The system according to claim 2 wherein said support means includes a strut depending from said keel to support said first drive shaft.

4. The system according to claim 2 wherein said support means includes: a strut depending from said craft, said aft propeller being secured to said strut at a location directly aft of said forward propeller; and means for selectively pivoting said strut and said aft propeller about a generally vertical axis to dynamically steer said craft, whereby said strut serves as a rudder.

5. The system according to claim 4 wherein said second drive means includes: a drive gear box housed in said strut and mechanically coupled between said second engine and said aft propeller.

6. The system according to claim 4 wherein said support means further comprises:

a ball joint assembly secured to the forward end of said strut, said ball joint assembly including a socket and a ball member engaged in said socket for universal rotation therein, said ball member having a bore extending therethrough and in which said first drive shaft extends and is freely rotatable about said first axis of rotation.

7. The system according to claim 6 wherein said first and second engines, said forward and aft propellers, said first drive shaft and said gear box all reside in a common vertical plane extending longitudinally through the center of said craft.

8. The system according to claim 7 wherein said first axis of rotation nominally subtends an acute angle relative to horizontal.

9. The system according to claim 1 wherein said first and second engines, said forward and aft propellers, and said first and second drive means reside in a common vertical plane extending longitudinally through said craft.

10. The system according to claim 1 wherein said first and second axes of rotation intersect in a common vertical plane when said forward and aft propellers are positioned to propel said craft in a direction parallel to its forward-to-aft dimension.

11. The system according to claim 2 wherein said support means includes: a strut depending from said craft, said aft propeller being secured to said strut at a location directly aft of said forward propeller; and means for selectively pivoting said strut and said aft propeller about a generally horizontal axis to permit said aft propeller to be moved to a location above the surface of the water.

12. The system according to claim 11 wherein said second drive means includes: a drive box housed in said strut and mechanically coupled between said second engine and said aft propeller.

13. The system according to claim 11 wherein said first and second engines, said forward and aft propellers, said first drive shaft and said gear box all reside in a common vertical plane extending longitudinally through the center of said craft.

* * * * *